US010401058B2

(12) United States Patent
Feng et al.

(10) Patent No.: US 10,401,058 B2
(45) Date of Patent: Sep. 3, 2019

(54) HEAT PUMP WITH EJECTOR

(71) Applicant: Carrier Corporation, Jupiter, FL (US)

(72) Inventors: Yinshan Feng, South Windsor, CT (US); Ahmad M. Mahmoud, Bolton, CT (US); Parmesh Verma, South Windsor, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 15/328,604

(22) PCT Filed: May 14, 2015

(86) PCT No.: PCT/US2015/030709

§ 371 (c)(1),
(2) Date: Jan. 24, 2017

(87) PCT Pub. No.: WO2016/014144

PCT Pub. Date: Jan. 28, 2016

(65) Prior Publication Data

US 2017/0211853 A1 Jul. 27, 2017

Related U.S. Application Data

(60) Provisional application No. 62/028,475, filed on Jul. 24, 2014.

(51) Int. Cl.

| | |
|---|---|
| ***F25B 13/00*** | (2006.01) |
| ***F25B 41/06*** | (2006.01) |
| ***F25B 41/04*** | (2006.01) |

(52) U.S. Cl.

CPC ..... *F25B 13/00* (2013.01); *F25B 41/04* (2013.01); *F25B 41/043* (2013.01);
(Continued)

(58) Field of Classification Search

CPC ..... F25B 13/00; F25B 41/043; F25B 2341/0011; F25B 2400/23
(Continued)

(56) References Cited

U.S. PATENT DOCUMENTS

| | | | | |
|---|---|---|---|---|
| 4,342,200 | A | 8/1982 | Lowi, Jr. | |
| 5,186,021 | A * | 2/1993 | Keller | F25B 41/06 137/513.3 |

(Continued)

FOREIGN PATENT DOCUMENTS

| | | | |
|---|---|---|---|
| CN | 102575882 | A | 7/2012 |
| EP | 0704663 | A1 | 4/1996 |

(Continued)

OTHER PUBLICATIONS

Yokozeki, Atsuhiko, Air Conditioner, May 22, 2008, English translation, European Patent Office.*

(Continued)

*Primary Examiner* — Frantz F Jules
*Assistant Examiner* — Steve S Tanenbaum
(74) *Attorney, Agent, or Firm* — Bachman & LaPointe, P.C.

(57) ABSTRACT

A system (20; 300; 500) comprises: a compressor (22) having a suction port (40) and a discharge port (42); an ejector (32) having a motive flow inlet (50), a suction flow inlet (52), and an outlet (54); a separator (34) having an inlet (72), a vapor outlet (74), and a liquid outlet (76); a first heat exchanger (24); at least one expansion device (28, 30; 520); a second heat exchanger (26); and a plurality of conduits and a plurality of valves (100, 120, 130, 140, 144, 148, 150; 100, 140, 144, 148, 150, 320, 340; 100, 120, 530). The conduits and valves are positioned to provide alternative operation in: a cooling mode; a first heating mode wherein the ejector has a motive flow and a suction flow and where utilizing a first
(Continued)

expansion device (30; 520) of the at least one expansion device; and a second heating mode utilizing the first expansion device and wherein the ejector has a suction flow and essentially no motive flow.

27 Claims, 7 Drawing Sheets

(52) U.S. Cl.
CPC ..... *F25B 41/062* (2013.01); *F25B 2341/0011* (2013.01); *F25B 2341/0661* (2013.01); *F25B 2400/23* (2013.01); *F25B 2700/2106* (2013.01)

(58) Field of Classification Search
USPC ..... 62/117
See application file for complete search history.

(56) References Cited

U.S. PATENT DOCUMENTS

| | | | | |
|---|---|---|---|---|
| 5,435,145 | A * | 7/1995 | Jaster | F25B 41/062 137/412 |
| 6,550,265 | B2 | 4/2003 | Takeuchi et al. | |
| 7,178,359 | B2 | 2/2007 | Oshitani et al. | |
| 2002/0124592 | A1* | 9/2002 | Takeuchi | F25B 9/008 62/500 |
| 2003/0140651 | A1 | 7/2003 | Takeuchi et al. | |
| 2004/0255602 | A1* | 12/2004 | Sato | F25B 6/00 62/159 |
| 2012/0180510 | A1* | 7/2012 | Okazaki | F25B 13/00 62/218 |
| 2013/0042640 | A1* | 2/2013 | Higashiiue | F25B 41/00 62/196.1 |
| 2014/0096557 | A1 | 4/2014 | Higashiiue | |

FOREIGN PATENT DOCUMENTS

| | | | |
|---|---|---|---|
| EP | 2728278 | A1 | 5/2014 |
| JP | 2008116124 | A * | 5/2008 |
| JP | 2008116124 | A * | 5/2008 |
| JP | 2009270785 | A * | 11/2009 |
| JP | 2009270785 | A * | 11/2009 |

OTHER PUBLICATIONS

Carrier Corporation, 50HCQ*04-12 Single Package Heat Pump/Electric Heat Nominal 3 to 10 Tons with Puron (R-410A) Refrigerant, Service and Maintenence Instructions, May 2012, Indianapolis, Indiana, pp. 11-12.*

Carrier Corporation, 50HCG*04-12 Single Package Heat Pump/Electric Heat Nominal 3 to 10 Tons with Puron (R-410A) Refrigerant , Service and Maintenence Instructions, May 2012, Indianapolis, Indiana, pp. 11-12 (Year: 2012).*

50HCQ*04-12 Single Package Heat Pump/Electric Heat Nominal 3 to 10 Tons With Puron (R-410A) Refrigerant, Service and Maintenance Instructions, May 2012, Carrier Corporation, Indianapolis, Indiana.

International Search Report and Written Opinion dated Aug. 7, 2015 for PCT Application No. PCT/US2015/030709.

Chinese Office Action dated Nov. 19, 2018 for Chinese Patent Application No. 201580041192.3.

* cited by examiner

HEAT PUMP WITH EJECTOR

CROSS-REFERENCE TO RELATED APPLICATION

Benefit is claimed of U.S. Patent Application No. 62/028,475, filed Jul. 24, 2014, and entitled "Heat Pump with Ejector", the disclosure of which is incorporated by reference herein in its entirety as if set forth at length.

U.S. GOVERNMENT RIGHTS

The invention was made with U.S. Government support under contract DE-EE0006108 awarded by the Department of Energy. The U.S. Government has certain rights in the invention

BACKGROUND

The disclosure relates to heat pumps. More particularly, the disclosure relates to heat pumps featuring an ejector.

Vapor compression systems have long been used for air conditioning. An exemplary vapor compression air conditioner comprises a refrigerant compressor, an outdoor heat exchanger downstream of the compressor along a refrigerant flowpath, an expansion device downstream of the outdoor heat exchanger, and an indoor heat exchanger downstream of the expansion device prior to the refrigerant flowpath returning to the compressor. Refrigerant is compressed in the compressor. Refrigerant then rejects heat in the outdoor heat exchanger and loses temperature. An exemplary outdoor heat exchanger is a refrigerant-air heat exchanger wherein fan-forced outdoor air acquires heat from refrigerant. By rejecting heat, the refrigerant may condense from vapor to liquid in the heat rejection heat exchanger. Accordingly, such exchangers are often referred to as condensers. In other systems, the refrigerant remains vapor and such are referred to as gas coolers.

The refrigerant expands in the expansion device and decreases in temperature. The reduced temperature of the refrigerant thus absorbs heat in the heat absorption heat exchanger (e.g., evaporator). Again, the evaporator may be a refrigerant-air heat exchanger across which a fan-forced interior/indoor airflow is driven with the interior/indoor airflow rejecting heat to the refrigerant.

Such vapor compression systems may also be used to heat interior spaces. In such cases, the refrigerant flow direction is altered to pass first from the compressor to the indoor heat exchanger and return from the outdoor heat exchanger to the compressor. Such arrangements are referred to as heat pumps.

In addition to simple expansion devices such as orifices and valves, ejectors have been used as expansion devices. Ejectors are particularly efficient where there is a large temperature difference between the indoor and outdoor environments. U.S. Pat. No. 6,550,265 of Takeuchi et al., issued Apr. 22, 2003, and entitled "Ejector Cycle System" discloses switching arrangements for use of an ejector in a cooling mode and a heating mode. US Patent Application Publication 2012/0180510A1 of Okazaki et al., published Jul. 19, 2012, and entitled "Heat Pump Apparatus" discloses a configuration with ejector and non-ejector heating modes and a non-ejector cooling mode.

An exemplary ejector is formed as the combination of a motive (primary) nozzle nested within an outer member or body. The ejector has a motive flow inlet (primary inlet) which may form the inlet to the motive nozzle. The ejector outlet may be the outlet of the outer member. A motive/primary refrigerant flow enters the inlet and then passes into a convergent section of the motive nozzle. It then passes through a throat section and an expansion (divergent) section and through an outlet of the motive nozzle. The motive nozzle accelerates the flow and decreases the pressure of the flow. The ejector has a secondary inlet forming an inlet of the outer member. The pressure reduction caused to the primary flow by the motive nozzle helps draw a suction flow or secondary flow into the outer member through the suction port. The outer member may include a mixer having a convergent section and an elongate throat or mixing section. The outer member also has a divergent section or diffuser downstream of the elongate throat or mixing section. The motive nozzle outlet may be positioned within the convergent section. As the motive flow exits the motive nozzle outlet, it begins to mix with the suction flow with further mixing occurring through the mixing section which provides a mixing zone.

Ejectors may be used with a conventional refrigerant or a $CO_2$-based refrigerant. In an exemplary operation with $CO_2$, the motive flow may typically be supercritical upon entering the ejector and subcritical upon exiting the motive nozzle. The secondary flow is gaseous (or a mixture of gas with a smaller amount of liquid) upon entering the secondary inlet. The resulting combined flow is a liquid/vapor mixture and decelerates and recovers pressure in the diffuser while remaining a mixture.

SUMMARY

One aspect of the disclosure involves a system comprising: a compressor having a suction port and a discharge port; an ejector having a motive flow inlet, a suction flow inlet, and an outlet; a separator having an inlet, a vapor outlet, and a liquid outlet; a first heat exchanger; at least one expansion device; a second heat exchanger; and a plurality of conduits and a plurality of valves. The conduits and valves are positioned to provide alternative operation in: a cooling mode; a first heating mode wherein the ejector has a motive flow and a suction flow and where utilizing a first expansion device of the at least one expansion device; and a second heating mode utilizing the first expansion device and wherein the ejector has a suction flow and essentially no motive flow.

In one or more embodiments of any of the foregoing embodiments, the system has only a single said expansion device.

Another aspect of the disclosure involves a system comprising: a compressor having a suction port and a discharge port; an ejector having a motive flow inlet, a suction flow inlet, and an outlet; a separator having an inlet, a vapor outlet, and a liquid outlet; a first heat exchanger; a first expansion device; a second heat exchanger; a second expansion device; and a plurality of conduits and a plurality of valves. The conduits and valves are positioned to provide alternative operation in three modes. In a first mode, a refrigerant flow is sequentially: passed from the compressor to the first heat exchanger; expanded in the first expansion device; passed through the second heat exchanger; passed to the suction flow inlet; passed from the ejector outlet to the separator inlet; and passed from the vapor outlet to the suction port. In a second mode, a refrigerant flow is sequentially: passed from the compressor to the second heat exchanger; passed to the motive flow inlet; mixed with an ejector suction flow passed through the suction flow inlet; passed from the ejector outlet to the separator inlet; separated in the separator into: a compressor suction flow passed to the suction port; and said ejector suction flow expanded in the second expansion device and passed through the first heat exchanger before reaching the ejector suction inlet. In a third mode, a refrigerant flow is sequentially: passed from the compressor to the second heat exchanger; expanded in the second expansion device; passed through the first heat exchanger; passed to the suction flow inlet; passed from the ejector outlet to the separator inlet; and passed from the vapor outlet to the suction port.

In one or more embodiments of any of the foregoing embodiments, the plurality of valves comprise a plurality of one-way check valves.

In one or more embodiments of any of the foregoing embodiments, the plurality of valves comprise: a first solenoid valve positioned to: in the first mode: block flow through the motive flow inlet; and in the second mode: pass flow from the second heat exchanger to the motive flow inlet; and a second solenoid valve positioned to: in the second mode: block flow from passing from the second heat exchanger directly to the second expansion device.

In one or more embodiments of any of the foregoing embodiments, the second solenoid valve is positioned to in the first mode prevent flow leakage from the first heat exchanger to the second heat exchanger.

In one or more embodiments of any of the foregoing embodiments, the plurality of valves comprise a three-way valve positioned to: in the first mode: block flow through the motive flow inlet and prevent flow leakage from the first heat exchanger to the second heat exchanger; and in the second mode: pass flow from the second heat exchanger to the motive flow inlet and block flow from passing from the second heat exchanger directly to the second expansion device.

In one or more embodiments of any of the foregoing embodiments, the plurality of valves comprise a switching valve having: a first port positioned to receive flow from the compressor discharge port; a second port positioned to pass flow to the ejector suction port; a third port positioned to communicate with the first heat exchanger; and a fourth port positioned to communicate with the second heat exchanger.

In one or more embodiments of any of the foregoing embodiments, the system has only a single ejector.

In one or more embodiments of any of the foregoing embodiments, the system has only a single four-port switching valve.

In one or more embodiments of any of the foregoing embodiments, the remaining said valves are only check valves and on-off solenoid valves or only check valves and a single three-way valve.

In one or more embodiments of any of the foregoing embodiments, the first heat rejection heat exchanger is a refrigerant-air heat exchanger; and the second heat rejection heat exchanger is a refrigerant-air heat exchanger.

In one or more embodiments of any of the foregoing embodiments, in the first mode and the third mode, there is no ejector motive flow.

In one or more embodiments of any of the foregoing embodiments, a controller is configured to switch the system between: running in the first mode; running in the second mode; and running in the third mode.

In one or more embodiments of any of the foregoing embodiments, the controller is configured to switch the system between said second mode and said third mode based on a sensed outdoor temperature.

In one or more embodiments of any of the foregoing embodiments, a method for using the system comprises: running in the first mode; running in the second mode; and running in the third mode.

In one or more embodiments of any of the foregoing embodiments, the method further comprises selecting which of the second mode and third mode in which to run based at least partially on a sensed outdoor temperature.

In one or more embodiments of any of the foregoing embodiments, a switching between at least two of the modes comprises actuating a single 4-way switching valve and no more than one 3-way switching valve.

In one or more embodiments of any of the foregoing embodiments, the switching between at least two of the modes comprises a switching between at least two of the modes comprises actuating a single 4-way switching valve, no 3-way switching valves, and a plurality of 2-way solenoid valves.

Another aspect of the disclosure involves a system comprising: a compressor having a suction port and a discharge port; an ejector having a motive flow inlet, a suction flow inlet, and an outlet; a separator having an inlet, a vapor outlet, and a liquid outlet; a first heat exchanger; a first expansion device; a second heat exchanger; a second expansion device; and a plurality of conduits and a plurality of valves. The conduits and valves are positioned to provide alternative operation in: a cooling mode utilizing the first expansion device; a first heating mode wherein the ejector has a motive flow and a suction flow; and, a second heating mode utilizing the second expansion device and wherein the ejector has a suction flow and essentially no motive flow.

In one or more embodiments of any of the foregoing embodiments, in the cooling mode the ejector has a suction flow and essentially no motive flow.

In one or more embodiments of any of the foregoing embodiments, the system has only a single ejector.

In one or more embodiments of any of the foregoing embodiments, the system has only a single 4-way switching valve and at most a single 3-way switching valve.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
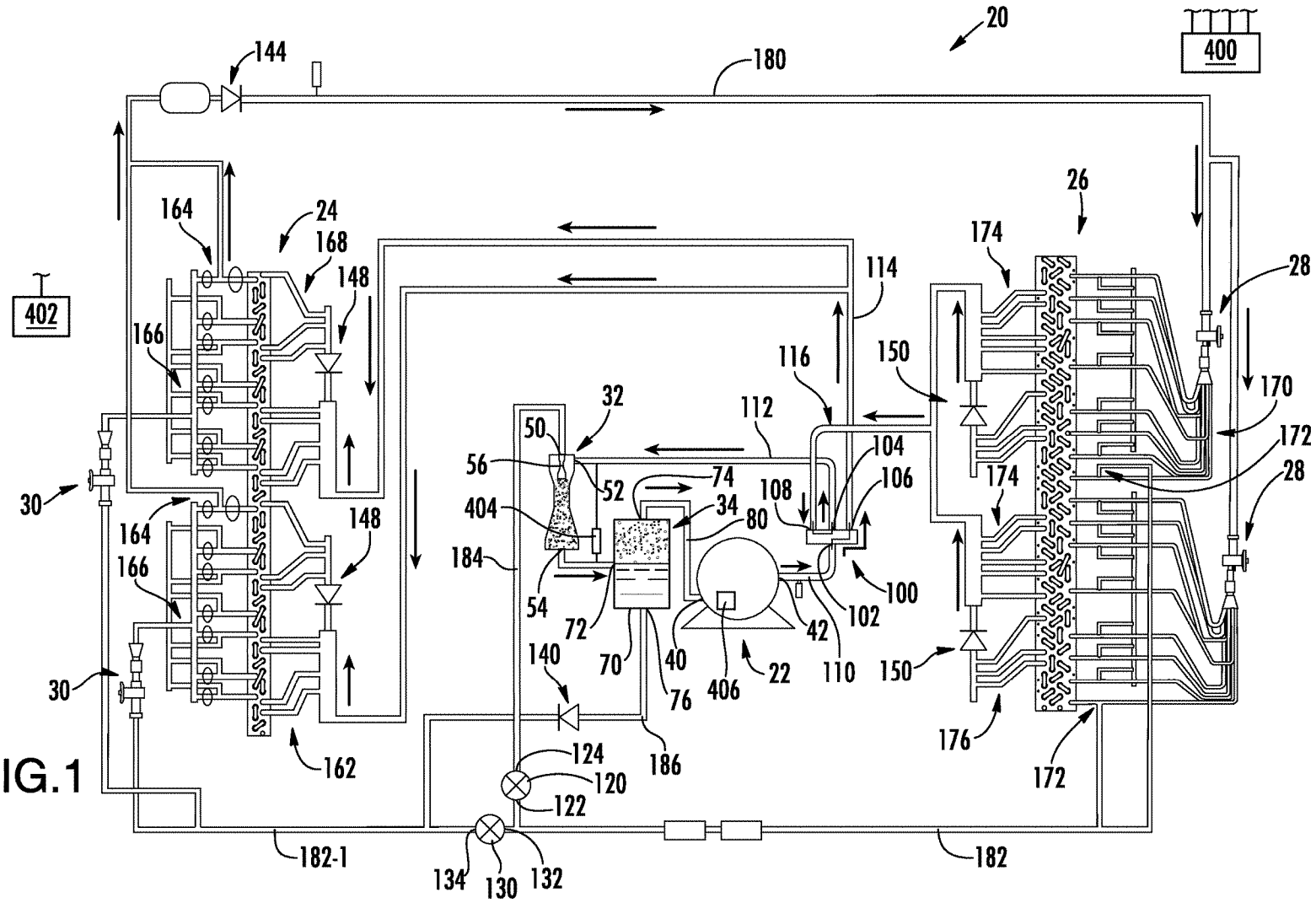
FIG. 1 is a schematic view of a vapor compression system showing refrigerant flow directions associated with a cooling mode.

FIG. 1 shows a vapor compression system 20 comprising one or more compressors 22 for driving a flow of refrigerant along a recirculating flow path. The system further includes at least one first heat exchanger 24 and at least one second heat exchanger 26. In an exemplary heat pump/air conditioner, the exemplary first heat exchanger is an outdoor coil and the exemplary second heat exchanger is an indoor coil.

The exemplary illustrated system is shown as a schematically marked-up modification of a baseline Carrier 50HCQ heat pump of Carrier Corporation. That baseline system had two compressors servicing respective circuits, each having its own sections of the indoor coil (heat exchanger 26) and outdoor coil (heat exchanger 24) for full redundancy. The exemplary modification replaces the two compressors with a single compressor but retains the splitting of the coils for partial redundancy. Nevertheless, dual compressors (or more) and/or multiple (or single) circuits are possible.

In the FIG. 1 cooling or air conditioning mode, the first heat exchanger 24 is a heat rejection heat exchanger and the second heat exchanger 26 is a heat absorption heat exchanger. For example, the heat exchanger 24 may be an outdoor heat exchanger and the heat exchanger 26 may be an indoor heat exchanger. In certain air temperature control examples, both heat exchangers may be refrigerant-air heat exchangers. In other examples, such as chillers, one or both heat exchangers may be a refrigerant-water heat exchanger or the like.

Figure 2:
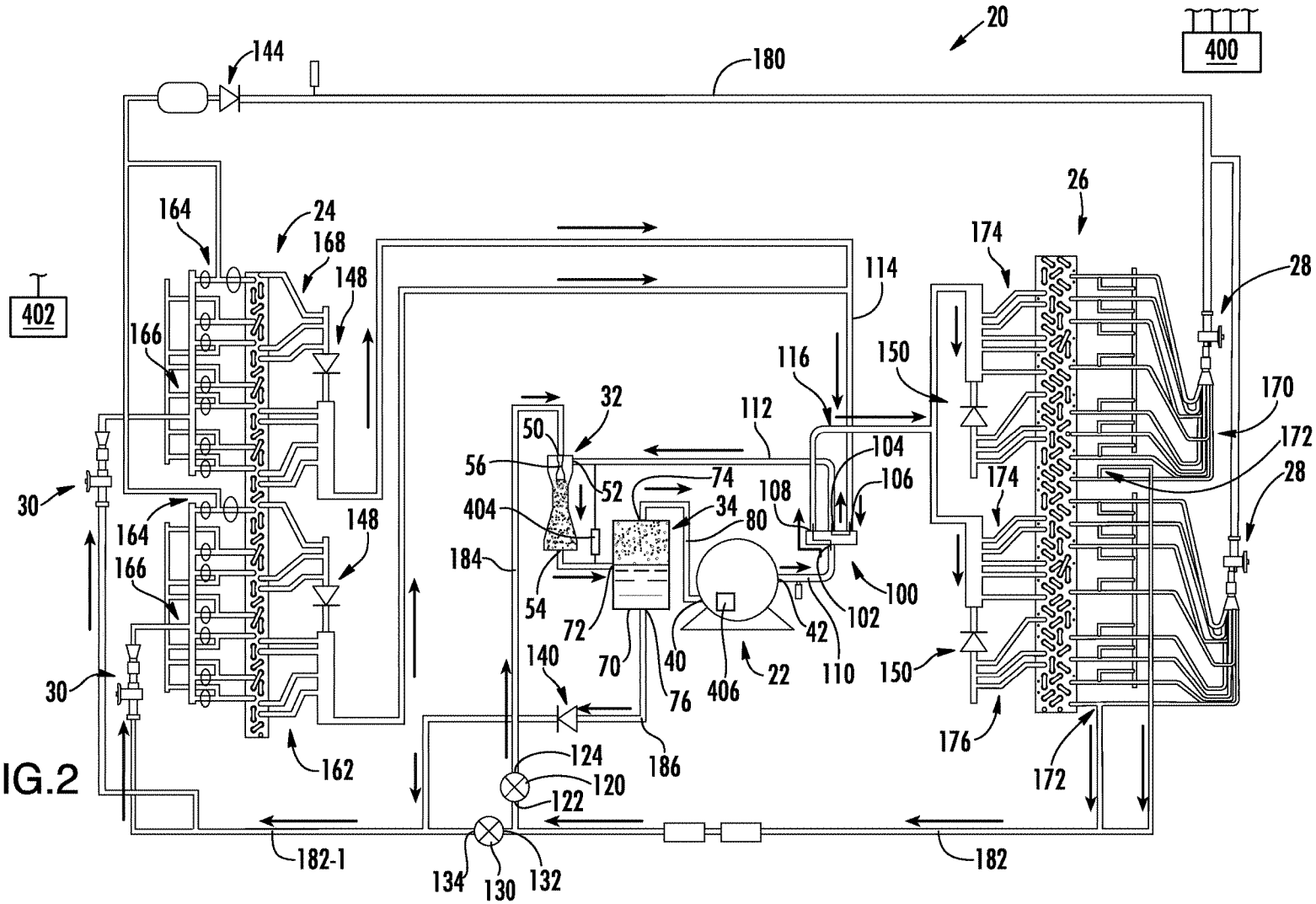
FIG. 2 is a schematic view of the system of FIG. 1 showing refrigerant flow directions associated with a first heating mode.
Figure 3:
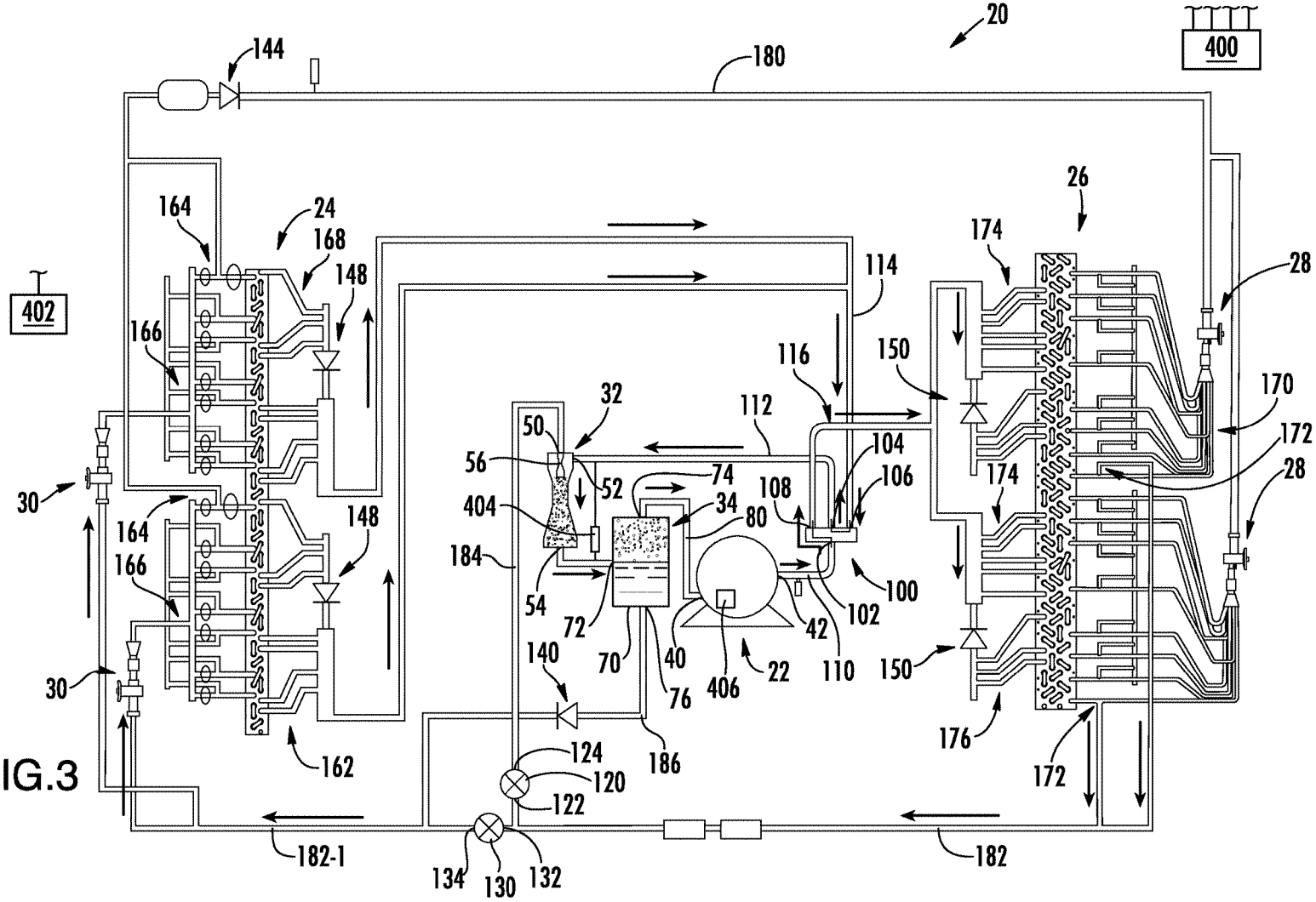
FIG. 3 is a schematic view of the system of FIG. 1 showing refrigerant flow directions associated with a second heating mode.

In the FIG. 2 and FIG. 3 heat pump (heating) modes, the thermal functions of the two heat exchangers are essentially reversed relative to the FIG. 1 cooling mode. The heat exchanger 24 is a heat absorption heat exchanger and the heat exchanger 26 is a heat rejection heat exchanger.

The exemplary system includes one or more first expansion devices 28 and one or more second expansion devices 30. As is discussed further below, the system also includes an ejector 32 and a separator 34. The FIG. 2 and FIG. 3 modes differ from each other in the roles of the expansion devices and ejector. The FIG. 2 mode makes full use of the ejector as an expansion device and may be used in a relatively low ambient temperature range. The FIG. 3 mode effectively disables the ejector (e.g., no motive flow or essentially no motive flow as would be associated with internal leakage levels of flow not sufficient for driving the associated lows through the suction port) and relies on one or more of the other expansion devices. The FIG. 3 mode may be used in a relatively high ambient temperature range.

The compressor has a suction port (inlet) 40 and a discharge port (outlet) 42. The ejector comprises a motive flow inlet (primary inlet) 50, a suction flow inlet (secondary flow inlet) 52 and an outlet 54. The exemplary ejector comprises a motive flow nozzle 56 positioned to receive a motive flow through the motive flow inlet 50 upstream of a mixing location for flow delivered through the suction flow inlet 52.

The separator 34 comprises a vessel 70 having an inlet port 72, a vapor outlet 74, and a liquid outlet 76. A liquid accumulation may be in a lower portion of the vessel and vapor in its headspace. A compressor suction line 80 extends between vapor outlet 74 and the compressor suction port 40.

Interconnecting the various components are a plurality of conduits and a plurality of additional components including valves, filters, strainers, and the like. As is discussed further below, the valves include a four-way switching valve 100 having a first port 102. The first port serves as an inlet connected to the discharge port 42 of the compressor via an associated discharge line 110. The switching valve 100 further comprises a second port 104, a third port 106, and a fourth port 108. The exemplary valve is configured with a rotary valve element having passageways for establishing two conditions of operation: selectively placing the first port 102 in communication with one of the third port and fourth port while placing the second port 104 in communication with the other. Actuation of the valve element between these two conditions, along with other valve actuations discussed below, facilitates transition between the three modes of operation.

FIG. 1 further shows a controllable valve 120 having ports 122 and 124 and the controllable valve 130 having ports 132 and 134. FIG. 1 also shows check valves 140, 144, 148, and 150.

The FIG. 1 cooling mode effectively disables the ejector (e.g., no motive flow) and relies on one or more of the other expansion devices. In this specific example, the expansion devices 28 are utilized and the expansion devices 30 are not. This allows the expansion devices in closest proximity to the heat rejection heat exchanger to service that heat exchanger. Refrigerant compressed by compressor 22 passes through the valve 100 to the heat exchanger 24. The two exemplary heat exchangers or sub-units thereof each have four general places for flow inlet or outlet. In the heat exchanger 24, these four places include a first inlet port (shown as a manifold) 162 coupled to receive refrigerant from the compressor, a first outlet port 164 positioned to pass refrigerant to the heat exchanger 26 (via the expansion device(s) 28), a second inlet port 166 positioned to receive refrigerant from the expansion device(s) 30 and a second outlet port (shown as a manifold) 168 to return refrigerant back to the compressor. In the cooling mode, however, only the inlet 162 and outlet 164 are operative. The positioning of the check valves 148 prevents entry of refrigerant through the inlet 168 and the outlet 160 and the high pressure of the compressor prevents any opposite flow. Similarly, check valve 140 and valve 130 block the only route through the ports 166 back to the compressor bypassing the other heat exchanger 26. Accordingly, in this condition, no flow will pass through the ports 166. The check valve 144 is positioned in a line 180 to allow the flow to pass from the heat exchanger 24 to the heat exchanger 26. As is discussed below, it is positioned to block opposite flows which might otherwise occur in other modes. Accordingly, the line or conduit 180 only carries flow in the cooling mode. In that cooling mode, it carries a liquid flow from the heat rejection heat exchanger to the expansion devices 28 associated with the heat absorption heat exchanger. In the heating modes discussed below, combinations of other lines are involved.

Similarly, each heat exchanger 26 or section thereof has a port 170 (e.g., shown as a manifold) associated with the expansion device(s) 28, an outlet port 172 (used only during heating) to the compressor, and ports 174 and 176 shown as manifolds. Each exemplary check valve 150 is positioned between an associated port 174 and 176. In the cooling mode, the check valve 150 is positioned to permit parallel flow through these ports to, in turn, pass to the ejector and return to the compressor. The return flow from the heat exchanger 26 is essentially vapor and passes as vapor through the ejector suction port, ejector outlet, and separator 34, exiting the vapor outlet 74 to return to the compressor suction port 40. Prior to reaching ejector suction port 52, the refrigerant passes through the ports 108 and 104 of the switching valve 100.

A defrost mode (not shown) for defrosting the heat exchanger 24 may be similar to the FIG. 1 cooling mode. For example, an electric fan (not shown) that would normally drive an air flow across the heat exchanger 24 may be shut down to limit heat rejection in the heat exchanger 24. This will raise the temperature of refrigerant delivered to the heat exchanger 24 to cause the heat exchanger 24 to reject heat to melt any ice buildup. An electric heater (not shown) downstream of the heat exchanger 26 along an air flowpath driven by an indoor fan (not shown) may heat the indoor air to avoid undesirable cooling of indoor air by the heat exchanger 26.

Figure 4:
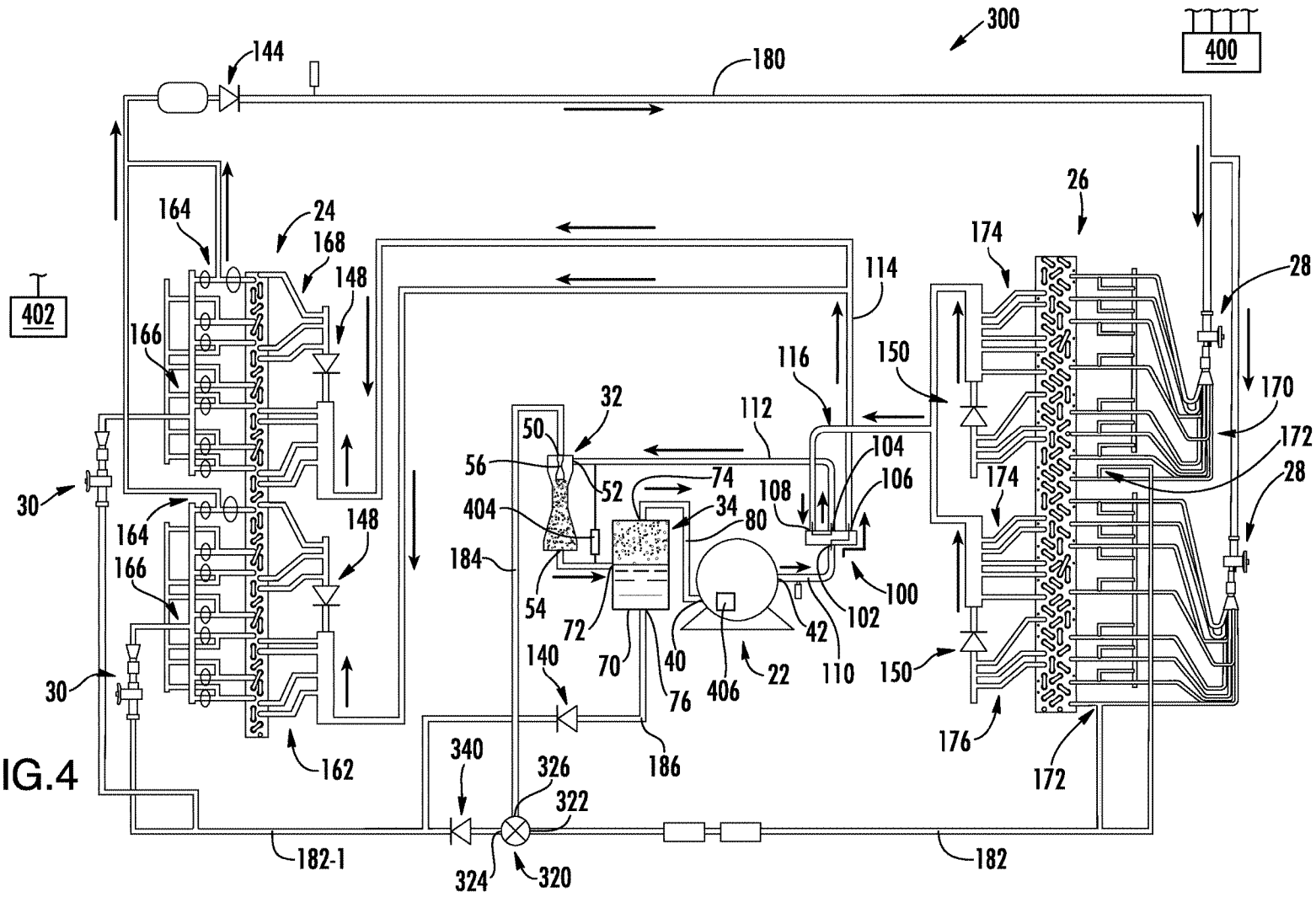
FIG. 4 is a schematic view of a second vapor compression system showing refrigerant flow directions associated with a cooling mode.

In an alternative configuration 300 of FIG. 4, the valves 120 and 130 are replaced with a single three-way valve 320 (having ports 322, 324, and 326) that provides selective communication between the upstream portion of the line 182 and, on the one hand, the line 184 and on the other hand, the downstream portion 182-1 and line 186. In this embodiment, an additional check valve 340 is placed in the line 182 between the three-way valve 320 and the junction of the line 186 and line 182. In this example, in the cooling mode, the valve 320 is positioned to block communication between the upstream portion of the line 182 on the one hand and the portion of the line 184 on the opposite side of the valve 420 on the other hand. This leaves communication between the upstream and downstream portions of the line 182. Accordingly, the check valve 340 serves to prevent any backflow. This becomes relevant because the expansion device(s) 30 may have some residual opening even in a closed condition. This would otherwise cause backflow through the line 182. However, this backflow is prevented by the check valve 340 as backflow through the line 186 is prevented by the check valve 140.

The FIG. 2 heating mode utilizes the ejector as an ejector/expansion device. To switch into this mode (or the FIG. 3 heating mode discussed below) the switching valve 100 is actuated from its FIG. 1 condition to its FIG. 2/3 condition. In this condition, communication is established between the ports 102 and 108 and separate communication is established between the ports 104 and 106. The result is that compressed refrigerant is delivered from the compressor to the second heat exchanger 26 and refrigerant passing from the first heat exchanger 24 is passed to the ejector suction port 52.

In the FIG. 2 heating mode, there is a motive flow through the ejector to entrain/drive the ejector suction flow. To provide such motive flow, the valve 120 is open. In the FIGS. 1 and 3 modes, the valve 120 is closed. In the FIG. 2 mode, refrigerant passes along the discharge line 110 from the compressor discharge port to the port 102 of the valve 100 and then passes through port 108 to a line 116 extending to the heat exchanger 26. Flow passes through the first port(s) 174 unimpeded and is unable to pass through the check valve 150 to the second port(s) 176.

The presence of the check valve 144 in line 180 prevents flow from passing in reverse through the port(s) 170 and expansion device(s) 28. Accordingly, all flow leaves through the port(s) 172 to a line 182. The refrigerant is diverted into a branch line 184 via a closed valve 130 in the line 182. In this mode, the valve 120 is open. The line 184 goes to the ejector motive inlet 50 to deliver the motive flow to the ejector. The suction flow of the ejector is provided by a return from the heat exchanger(s) 24 as is discussed below.

Flow, however, is delivered through a terminal portion 182-1 of the line 182 to the valve(s) 30 via a line 186 extending from the liquid outlet 76 of the separator so as to deliver liquid refrigerant. Line 186 intersects the line 182 downstream of the valve 130 (closed in this condition) and the check valve 142.

In the exemplary embodiment, refrigerant will not pass out the port(s) 164 because the heat exchanger 24 is at lower pressure than the heat exchanger 26 and, therefore, no additional check or other valves need be provided to block flow along the line 180. The refrigerant flow exiting the heat exchanger(s) 24 will pass through both the outlets 162 and 168. This will pass through the outlets 168 because of the orientation of the check valves 148 to permit this flow. These flow(s) proceed back via line 114 to the port 106 of the switching valve 100 and then out the port 104 via line 112 to the ejector suction inlet 52. This flow combined with the motive flow from line 184 enters the separator where it is separated. A vapor flow exits the port 74 to return along the compressor suction line to the compressor suction port 40. The liquid flow passes out the outlet 76 into the line 186 as was discussed above.

The FIG. 2 mode may be used in situations where ejector heat pumps are efficient. For example, this may be relevant where there is a relatively high temperature difference between indoor and outdoor conditions.

The FIG. 3 heating mode effectively disables the ejector (e.g., no motive flow) and relies on one or more of the other expansion devices. This mode may be used when an ejector is less efficient such as when there is a low temperature difference between indoor and outdoor conditions. Relative to the FIG. 2 mode, the valve 120 is closed and the valve 130 is open. Accordingly, fluid passes directly from the heat rejection heat exchanger(s) 26 to the expansion device(s) 30 via the line 182.

Figure 5:
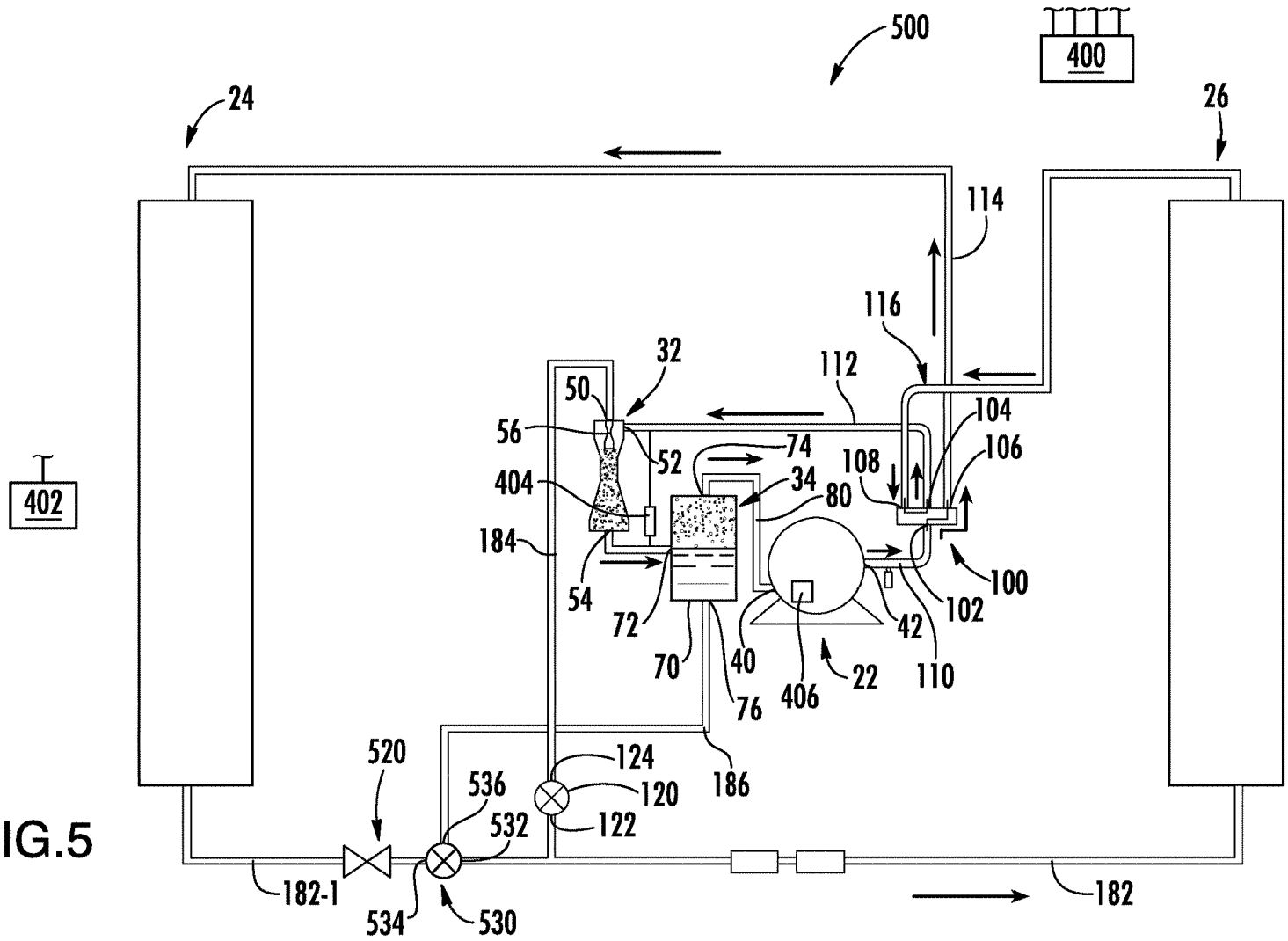
FIG. 5 is a schematic view of a third vapor compression system showing refrigerant flow directions associated with a cooling mode.
Figure 6:
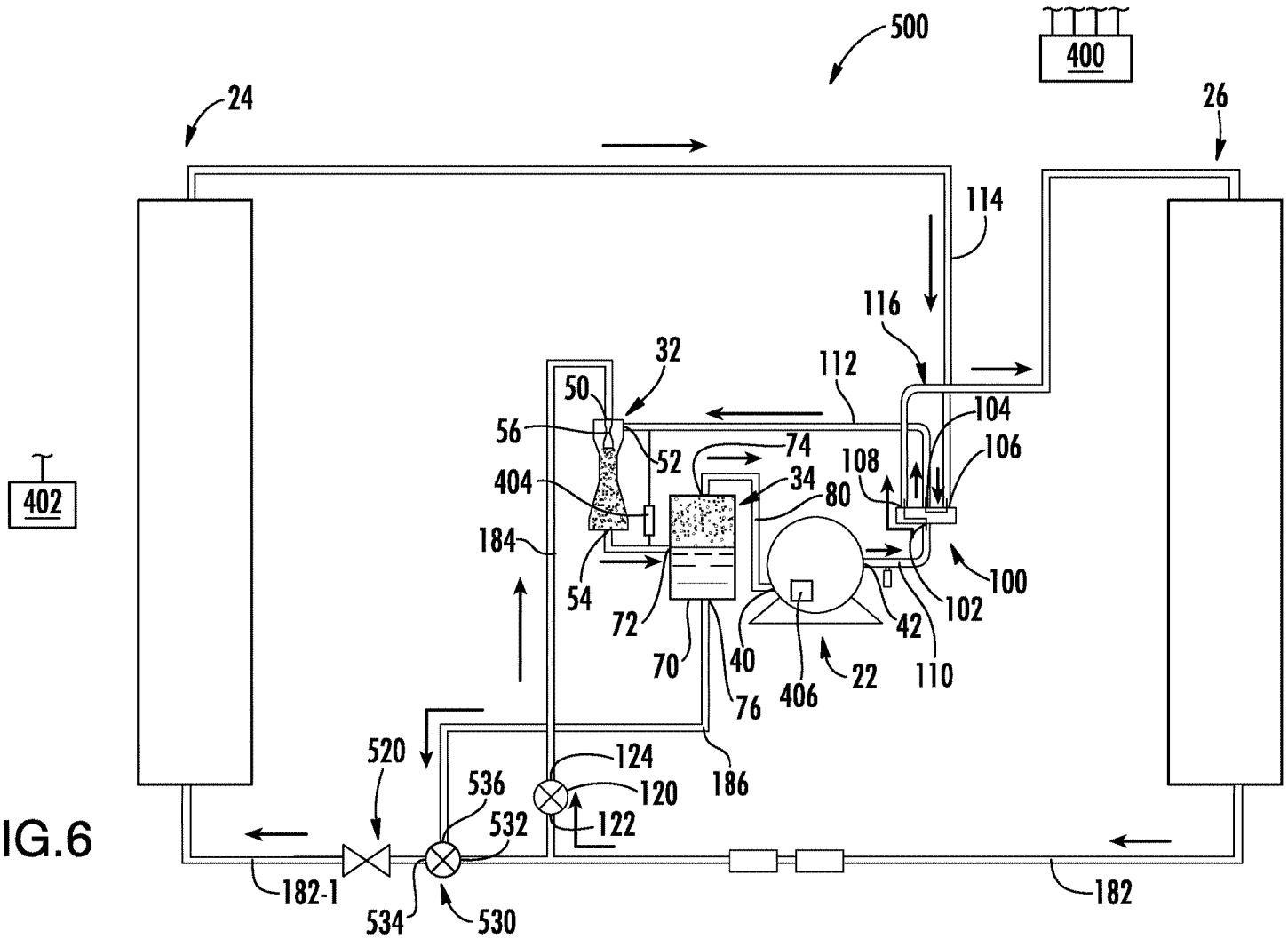
FIG. 6 is a schematic view of the system of FIG. 5 showing refrigerant flow directions associated with a first heating mode.
Figure 7:
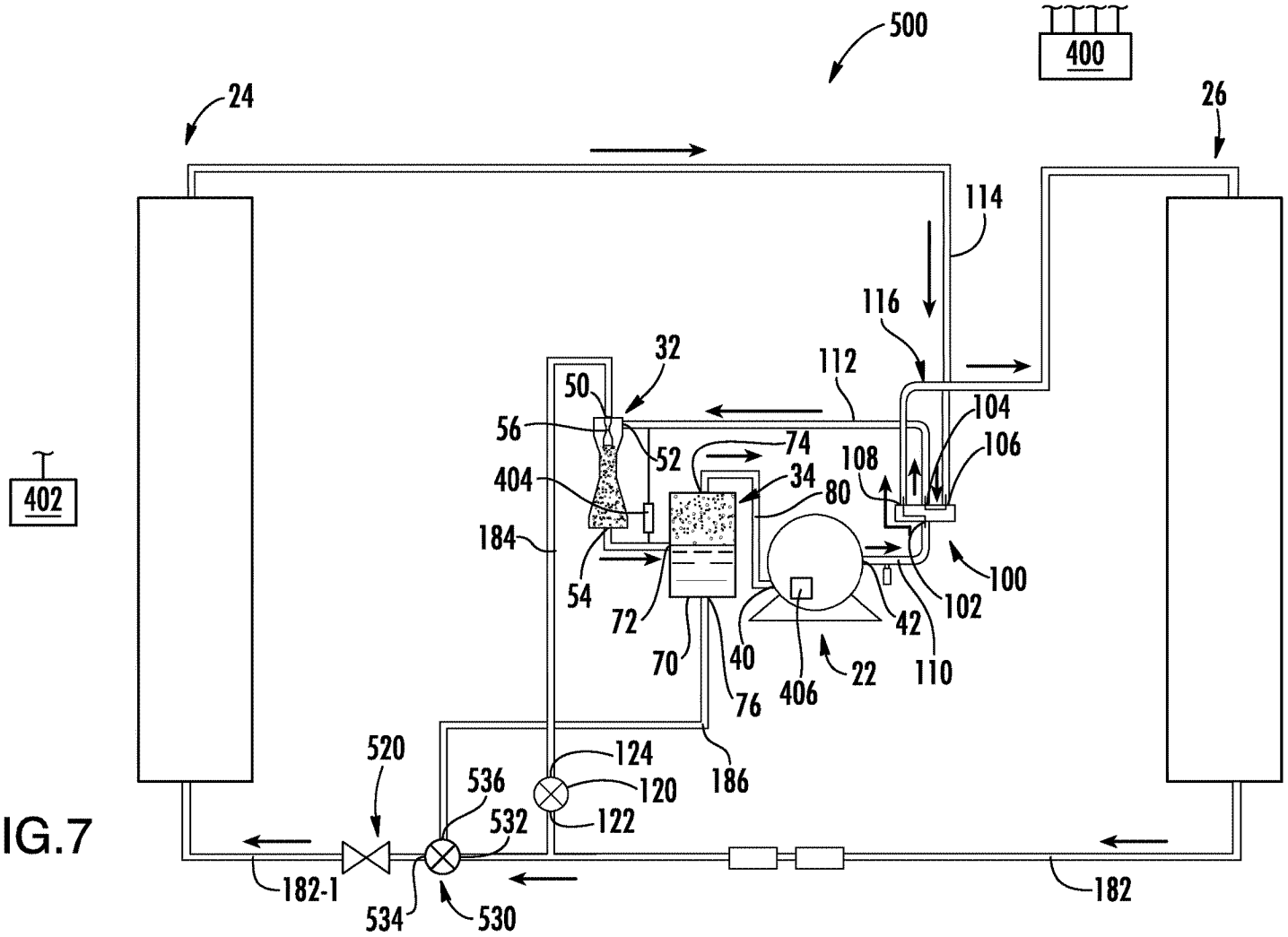
FIG. 7 is a schematic view of the system of FIG. 5 showing refrigerant flow directions associated with a second heating mode.

FIGS. 5-7 show a third vapor compression system 500 which is somewhat simplified relative to the system 20 of FIG. 1. Whereas the system 20 provides separate expansion devices or groups thereof 28 and 30 for use in different modes, the exemplary system 500 provides a single expansion device 520 (or group thereof) used in the different modes. Thus, whereas the expansion device(s) 30 are used in the heating modes and the expansion device(s) 28 are instead used in the cooling mode, the exemplary expansion device 520 is used in both heating modes and the cooling mode.

Thus, in the FIG. 5 cooling mode, the ejector is effectively disabled with essentially no motive flow but with a suction flow providing a compressor suction flow through the separator 34 which acts more as an accumulator as in the other embodiments. For example, leakage and issues of valve geometry, pressure relief, and the like may mean a small flow through the motive nozzle. However, this flow (if in the downstream direction of the ejector) is not commensurate with actually serving as a motive flow for the associated secondary flow. A valve 530 is positioned at an intersection of the line 182 and the line 186. The valve 530 is between the expansion device 520 and the intersection of the line 182 with line 184. In the FIG. 5 cooling mode, the valve 530 allows flow through the line 182 while blocking flow through the line 186. Accordingly, it may replace the function of the check valve 140.

In the FIG. 5 cooling mode, refrigerant discharged from the compressor passes through the valve 100 to the heat exchanger 24 which serves as a heat rejection heat exchanger. The refrigerant rejects heat in the heat exchanger 24 and then passes through the downstream portion 182-1 of line 182 through the expansion device 520 and then through ports 534 and 532 of the valve 530. Having expanded in the expansion device 520, the refrigerant has lost temperature prior to reaching the heat exchanger 26 which then serves as a heat absorption heat exchanger. The refrigerant passes from the heat absorption heat exchanger 26 through the valve 100 to the suction port 52 of the ejector then into the separator 34. From the separator 34, the vapor refrigerant passes through the line 80 to return to the compressor.

In the FIG. 6 ejector heating mode, the valve 100 is articulated relative to the FIG. 5 condition in similar fashion as the FIG. 2 condition is relative to the FIG. 1 condition. Accordingly, the refrigerant passes from the compressor through the port 108 of the valve 100 and to the heat exchanger 26. Thus, it is again seen that refrigerant flow through the heat exchanger 26 is in the opposite direction of its flow in the FIG. 5 mode. The heat exchanger 26 thus serves as a heat rejection heat exchanger in this mode. Refrigerant passes from the outlet of the heat exchanger 26 through the line 182. However, the valve 120 is open to allow refrigerant to bypass into the line 184 to reach the ejector motive flow port 50. With the ejector suction port 52 receiving flow (discussed below), the ejector is fully operational/functional. The valve 530 is positioned to pass flow through its port 536 at the line 186 to the port 534 leading to the expansion device 520. The valve 530 blocks flow from the port 532 directly to the port 534. Accordingly, liquid refrigerant is received from the separator through the line 186 and delivered to the expansion device 520 where it is expanded and its temperature decreases. The expanded/cooled refrigerant enters the heat exchanger 24 which serves as a heat absorption heat exchanger. Again, this is a reversal of refrigerant flow direction through the heat exchanger 24 relative to the FIG. 5 mode so that inlet becomes outlet and outlet becomes inlet. Refrigerant passes from the heat exchanger 24 back through the port 106 of the valve 100 and then through the port 104 to become the suction flow previously mentioned.

The FIG. 7 non-ejector heating mode is generally similar to the FIG. 6 mode except that the valve 120 is closed blocking ejector motive flow through the line 184 and the valve 530 permits flow between the ports 532 and 534 while blocking the port 536 and line 186. Thus, the separator acts more purely as an accumulator.

Again, the refrigerant from the heat exchanger 26 is expanded in the expansion device 520 to provide expanded/cooled refrigerant to the heat exchanger 24. Thus, another characteristic of this third embodiment is that the same line 182 serves as the liquid line in all three modes.

A further defrost mode may be as discussed regarding the prior embodiments.

FIG. 1 further shows a controller 400. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

A control routine may be programmed or otherwise configured into the controller. The routine provides automatic selection of which of the two heating modes to use based on sensed conditions. In a reengineering of a baseline heat pump system, this selection may be superimposed upon the controller's normal programming/routines (e.g., providing the basic operation of baseline system to which the foregoing mode control is added). In one example, the switching of the two heating modes can be controlled responsive only to the outdoor ambient temperature sensor 402 and/or a pressure transducer 404 (positioned to sense pressure difference between the ejector port 52 and port 54), and/or the compressor speed signal (from a sensor 406 or logic internal to the controller). For example, the ejector can be enabled during the heating mode once the temperature sensor 402 reading is below a threshold (e.g., 32° F. (0° C.)), and/or once the pressure sensor 404 reading is less than a certain target number (e.g., 2 psid (14 kPa)), and/or once the compressor reaches its minimum speed.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A system (500) comprising:

a compressor (22) having a suction port (40) and a discharge port (42);

an ejector (32) having a motive flow inlet (50), a suction flow inlet (52), and an outlet (54);

a separator (34) having an inlet (72), a vapor outlet (74), and a liquid outlet (76);

a first heat exchanger (24);

a single expansion device (520);

a second heat exchanger (26); and a plurality of conduits and a plurality of valves positioned to provide alternative non-economized operation in:

a cooling mode using the single expansion device (520) and the separator functions as an accumulator without flow from the liquid outlet;

a first heating mode wherein the ejector has a motive flow and a suction flow and utilizing the single expansion device to expand refrigerant received from the separator liquid outlet; and a second heating mode utilizing the single expansion device and wherein the ejector has a suction flow and essentially no motive flow and the separator functions as an accumulator without flow from the liquid outlet.

2. The system of claim 1 wherein in the cooling mode the ejector has a suction flow and essentially no motive flow.

3. The system of claim 1 wherein:

the system is a non-economized system having only a single ejector.

4. The system of claim 1 wherein:

the system has only a single 4-way switching valve and at most a single 3-way switching valve.

5. A system (20; 300) comprising:

a compressor (22) having a suction port (40) and a discharge port (42);

an ejector (32) having a motive flow inlet (50), a suction flow inlet (52), and an outlet (54);

a separator (34) having an inlet (72), a vapor outlet (74), and a liquid outlet (76);

a first heat exchanger (24);

a first expansion device (28);

a second heat exchanger (26);

a second expansion device (30);

a first line (80) between the first heat exchanger and the second heat exchanger;

a second line (82) between the first heat exchanger and the second heat exchanger; and a plurality of conduits and a plurality of valves (100, 120, 130, 140, 144, 148, 150; 100, 140, 144, 148, 150, 320, 340) positioned to provide alternative non-economized operation in:

a first mode wherein a refrigerant flow is sequentially without passing through the second expansion device:

passed from the compressor to the first heat exchanger;

passed from the first heat exchanger along the first line and expanded in the first expansion device;

passed through the second heat exchanger;

passed to the suction flow inlet;

passed from the ejector outlet to the separator inlet; and passed from the vapor outlet to the suction port;

a second mode wherein a refrigerant flow is sequentially without passing through the first expansion device:

passed from the compressor to the second heat exchanger;

passed to the motive flow inlet;

mixed with an ejector suction flow passed through the suction flow inlet;

passed from the ejector outlet to the separator inlet; and separated in the separator into:

a compressor suction flow passed to the suction port; and said ejector suction flow expanded in the second expansion device and passed through the first heat exchanger before reaching the ejector suction inlet; and;

a third mode wherein a refrigerant flow is sequentially without passing through the first expansion device:

passed from the compressor to the second heat exchanger;

passed from the second heat exchanger along the second line and expanded in the second expansion device;

passed through the first heat exchanger;

passed to the suction flow inlet;

passed from the ejector outlet to the separator inlet; and passed from the vapor outlet to the suction port.

6. The system of claim 5 wherein the plurality of valves comprise:

a plurality of one-way check valves (140, 144, 148, 150; 140, 144, 148, 150, 340).

7. The system of claim 5 wherein the plurality of valves comprise:

a first solenoid valve (120) positioned to:

in the first mode:

block flow through the motive flow inlet; and in the second mode:

pass flow from the second heat exchanger to the motive flow inlet; and a second solenoid valve (130) positioned to:

in the second mode:

block flow from passing from the second heat exchanger directly to the second expansion device.

8. The system of claim 7 wherein:

the second solenoid valve is positioned to in the first mode prevent flow leakage from the first heat exchanger to the second heat exchanger.

9. The system of claim 5 wherein the plurality of valves comprise:

a three-way valve (320) positioned to:

in the first mode:

block flow through the motive flow inlet and prevent flow leakage from the first heat exchanger to the second heat exchanger; and in the second mode:

pass flow from the second heat exchanger to the motive flow inlet and block flow from passing from the second heat exchanger directly to the second expansion device.

10. The system of claim 5 wherein the plurality of valves comprise:

a switching valve (100) having:

a first port (102) positioned to receive flow from the compressor discharge port;

a second port (104) positioned to pass flow to the ejector suction port;

a third port (106) positioned to communicate with the first heat exchanger; and a fourth port (108) positioned to communicate with the second heat exchanger.

11. The system of claim 5 wherein:

the system has only a single ejector.

12. The system of claim 5 wherein:

the system has only a single four-port switching valve (100).

13. The system of claim 12 wherein:

the remaining said valves of said plurality of valves are only check valves and on-off solenoid valves or only check valves and a single three-way valve.

14. The system of claim 5 wherein:

the first heat rejection heat exchanger is a refrigerant-air heat exchanger; and the second heat rejection heat exchanger is a refrigerant-air heat exchanger.

15. The system of claim 5 wherein:

in the first mode and the third mode, there is no ejector motive flow.

16. The system of claim 5 further comprising a controller (400) configured to switch the system between:

running in the first mode;

running in the second mode; and running in the third mode.

17. The system of claim 16 wherein the controller (400) is configured to switch the system between said second mode and said third mode based on a sensed outdoor temperature wherein the controller is configured to switch from the second mode to the third mode when a sensed outdoor temperature falls below a threshold.

18. The system of claim 5 wherein the plurality of conduits include:

a first conduit (180) and a second conduit (182) wherein the first conduit is along a first flowpath from the first heat exchanger to the second heat exchanger via the first expansion device and the second conduit is along a second flowpath from the second heat exchanger to the first heat exchanger via the second expansion device, a first flowpath from the first heat exchanger to the first expansion device not overlapping with a second flowpath from the second heat exchanger to the second expansion device.

19. A method for using the system of claim 5, the method comprising:

running in the first mode;

running in the second mode; and running in the third mode.

20. The method of claim 19 further comprising:

selecting which of the second mode and third mode in which to run based at least partially on a sensed outdoor temperature; and switching the system between:

running in the first mode;

running in the second mode in a first outdoor temperature range; and running in the third mode in a second outdoor temperature range higher than the first outdoor temperature range.

21. The method of claim 19 wherein:

a switching between at least two of the modes comprises actuating a single 4-way switching valve and no more than one 3-way switching valve.

22. The method of claim 19 wherein:

the switching between at least two of the modes comprises a switching between at least two of the modes comprises actuating a single 4-way switching valve, no 3-way switching valves, and a plurality of 2-way solenoid valves.

23. A system (20; 300) comprising:

a compressor (22) having a suction port (40) and a discharge port (42);

an ejector (32) having a motive flow inlet (50), a suction flow inlet (52), and an outlet (54);

a separator (34) having an inlet (72), a vapor outlet (74), and a liquid outlet (76);

a first heat exchanger (24);

a first expansion device (28);

a second heat exchanger (26);

a second expansion device (30);

a plurality of conduits including a first conduit (180) and a second conduit (182) wherein the first conduit is along a first flowpath from the first heat exchanger to the second heat exchanger via the first expansion device and the second conduit is along a second flowpath from the second heat exchanger to the first heat exchanger via the second expansion device; a first flowpath from the first heat exchanger to the first expansion device not overlapping with the second flowpath from the second heat exchanger to the second expansion device; and a plurality of valves (100, 120, 130, 140, 144, 148, 150; 100, 140, 144, 148, 150, 320, 340), wherein the plurality of conduits and the plurality of valves are positioned to provide alternative operation in:

a cooling mode utilizing the first expansion device and the separator functions as an accumulator without flow from the liquid outlet;

a first heating mode wherein the ejector has a motive flow and a suction flow; and a second heating mode utilizing the second expansion device and wherein the ejector has a suction flow and essentially no motive flow and the separator functions as an accumulator without flow from the liquid outlet.

24. The system of claim 23 wherein in the cooling mode the ejector has a suction flow and essentially no motive flow.

25. The system of claim 23 wherein:

the system has only a single ejector.

26. The system of claim 23 wherein:

the system has only a single 4-way switching valve and at most a single 3-way switching valve.

27. The system of claim 23 further comprising a controller (400) configured to switch the system between:

running in the cooling mode;

running in the first heating mode in a first outdoor temperature range; and running in the second heating mode in a second outdoor temperature range higher than the first outdoor temperature range.

* * * * *